US011324083B1

(12) United States Patent
Rahman

(10) Patent No.: US 11,324,083 B1
(45) Date of Patent: May 3, 2022

(54) APPARATUS FOR INTELLIGENT AND SELECTIVE HEATING USING SENSOR ARRAY

(71) Applicant: Muhammad Shahir Rahman, Portland, OR (US)

(72) Inventor: Muhammad Shahir Rahman, Portland, OR (US)

( * ) Notice: Subject to any disclaimer, the term of this patent is extended or adjusted under 35 U.S.C. 154(b) by 255 days.

(21) Appl. No.: 15/257,767

(22) Filed: Sep. 6, 2016

Related U.S. Application Data

(60) Provisional application No. 62/214,982, filed on Sep. 6, 2015.

(51) Int. Cl.
*H05B 6/64* (2006.01)
*H05B 6/78* (2006.01)
*H05B 6/80* (2006.01)

(52) U.S. Cl.
CPC ..... *H05B 6/6455* (2013.01); *H05B 6/6411* (2013.01); *H05B 6/6435* (2013.01); *H05B 6/782* (2013.01); *H05B 6/80* (2013.01)

(58) Field of Classification Search
CPC ..... H05B 6/6455; F24C 7/02; F24C 7/08
See application file for complete search history.

(56) References Cited

U.S. PATENT DOCUMENTS 3,767,883 A * 10/1973 Staats ..... H05B 6/6411 219/761
4,684,776 A * 8/1987 Heard ..... H05B 6/80 134/1
4,714,811 A * 12/1987 Gerling ..... H05B 6/6411 219/702
8,766,151 B1 * 7/2014 Weber ..... H05B 6/6411 219/708
2002/0005406 A1 * 1/2002 Fukunaga ..... H05B 6/6455 219/711
2013/0306627 A1 * 11/2013 Libman ..... H05B 6/6435 219/705
2014/0225064 A1 * 8/2014 Khoshakhlagh ..... H01L 31/035236 257/21
2014/0231418 A1 * 8/2014 Ikeda ..... H05B 6/645 219/705

(Continued)

FOREIGN PATENT DOCUMENTS

JP 2013162512 A * 8/2013 ..... H05B 6/705

*Primary Examiner* — Daniel J Colilla

(57) ABSTRACT

The use of heat is elemental in household applications, particularly in cooking apparatus, but they are not smart and automated, which often causes fires and other safety hazards. In fact, 42% of household fires are caused by cooking devices. In our modern household, all cooking devices require some kind of user input, such as time, temperature, food type etc. to determine how long to cook, often resulting in under/overcooking due to human error. This invention demonstrates advanced thermopile assisted remote temperature detection technology in conjunction with controlled feedback systems to effectively cook food. Extending this with the use of a computing device and "Internet Of Things," a revolutionary cooking apparatus has been devised that can automatically calculate & control the desired temperature of any food type & amount placed in the device without need of any user input. A working prototype has been created that includes all these features.

13 Claims, 11 Drawing Sheets

(56) References Cited

U.S. PATENT DOCUMENTS

2015/0289324 A1* 10/2015 Rober ..... H05B 6/68
219/711
2015/0312964 A1* 10/2015 Sorenson ..... F24C 15/105
219/448.13
2016/0302265 A1* 10/2016 Kreiner ..... H05B 6/666

* cited by examiner

APPARATUS FOR INTELLIGENT AND SELECTIVE HEATING USING SENSOR ARRAY

BACKGROUND

The main purpose of this research is to create a practical and intelligent microwave oven that can automatically cook the food to the desired temperature without any required user input. In household as well as industrial applications, heating is an essential element. Unfortunately, many of these appliances are not intelligent. Automation of the process can allow efficient cooking, eliminate human error and prevent any safety hazard caused by overheating. From 2007 to 2011, the U.S fire departments had to respond an average of 156,000 household fires per year in which cooking equipment was involved in the ignition of the fire. These fires caused $853M in direct property damage, 5080 civilian injuries and approximately 400 civilian deaths annually. 20% of them happened on children under five years old. This work will address all these issues by thoughtfully integrating technologies into a novel system.

PRIOR ART

In the current modern household, there are a variety of cooking devices such as kitchen stove, microwave oven, convection oven etc. However, none of these devices have any intelligence of their own. They all require some kind of user input such as time to cook/reheat, amount of food, power level, temperature etc. Some latest advanced microwave oven models claim to be intelligent but in reality they are based on pre profiled food types and user input of food amount. As such, the necessary parameters (such as weight, food type, temperature etc.) are actually "given" by the user as opposed to understood by the device resulting occasional erroneous result in overcooking, undercooking, hazardous burns to full scale flames causing mass damage & loss of lives & property.

Application of moisture sensor has been seen in a few models and studies of microwave power absorption have been reported. However gridded sensor array of thermopile has never been applied in any reported models of any kind. Also the combination of smart interface with computational heat modelling has never been done before. Application of thermopile has also not been reported for food characterization in or outside any cooking apparatus.

BRIEF DESCRIPTION OF INVENTION

In the new and improved design of cooking automation, a thermopile (or IR) gridded array inside a microwave oven is used to take the temperature map of the food. After the initial reading is taken, the cooking oven begins warming. As the food is warming, the thermopile continues to take real time temperature data of the entire area including food & platter where food is placed. The heat absorption of the food is meticulously tracked. Using proprietary correlation equations and intense mathematical optimization, the viscosity, amount and other properties of the food are computationally calculated.

Based on these values the desired temperature and the ending time of the food can be computed. The cooking time or target temperature can be changed based on a smartphone or any other IOT device application by a user if needed. The irregular heating zones inside a microwave cabin can be taken advantage of with a stepper motor to rotate the food platter in different directions so that only specific foods are warmed. User-specific temperature or time preferences are accounted for by a machine-learned database and a user profile target temperature (or time) variation modeling software. This is a novel design because the usage of mathematics and temperature data to determine properties of a food has never been seen and the aspect of Gallium Antimonide thermopiles has also has not been done before. Furthermore, the ensemble of intelligent software combined with the specific elements of the microwave oven cooking apparatus and its configurations in the larger system scheme is novel as well.

DETAILED DESCRIPTION OF INVENTION

Figure 1:
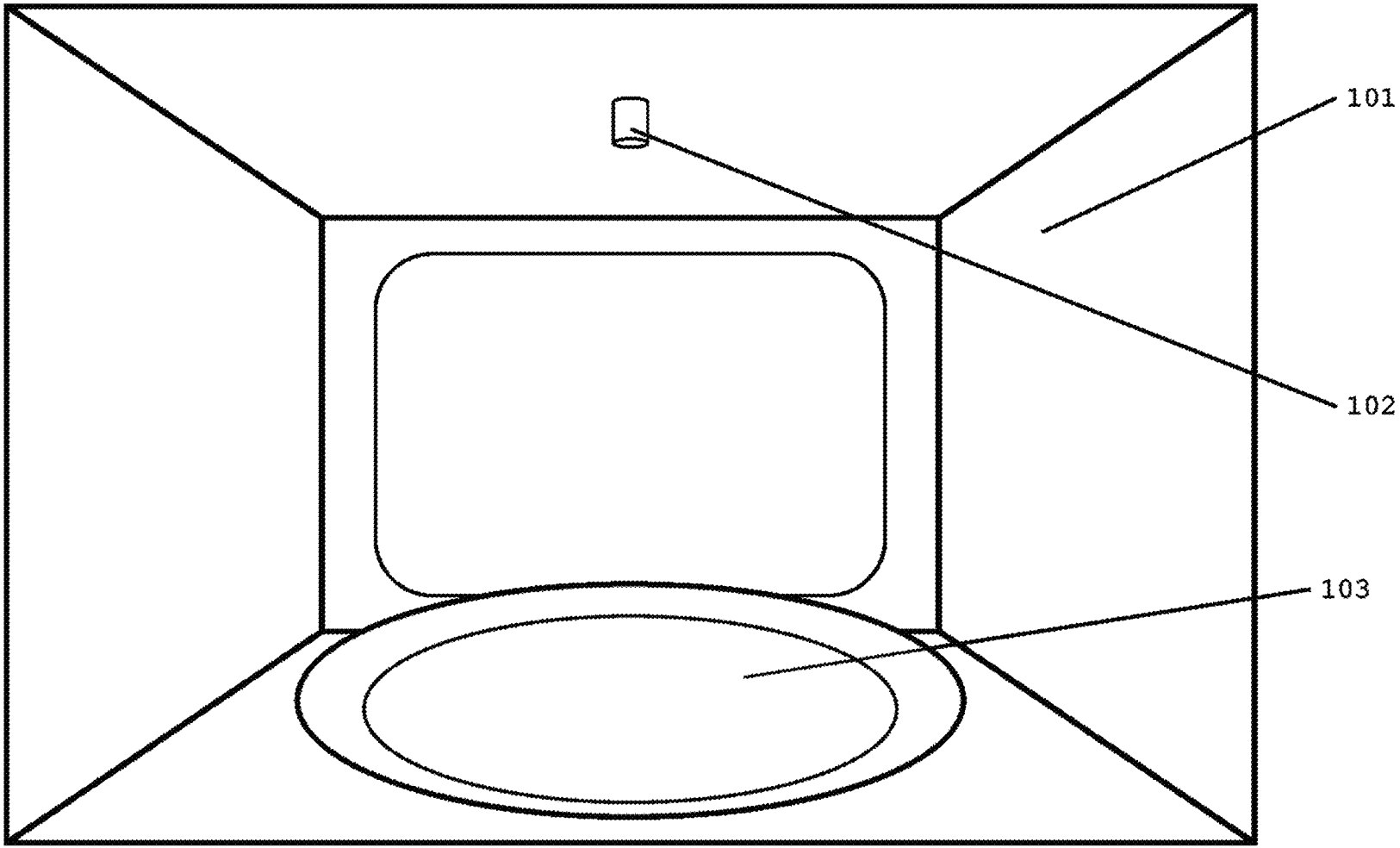
FIG. 1. is a diagram of the inside of the microwave oven enclosure showing the location of central temperature sensor array and the food platter in relation to the oven body.

The invention involves a microwave oven (FIG. 1) where an infrared sensor array 101, is placed in the top of the device so that a temperature map of the food can be taken as the food warms. The apparatus is enclosed in a metal body 102. The food platter 3 is in the center of the cabin below the infrared sensor and can be rotated by an electronic motor to provide even heating if needed.

Gallium Antimonide based thermopiles can be used for touch less temperature detection with greater accuracy and speed than the current state of art. Gallium Antimonide unlike other materials conventionally used in thermopiles for temperature detection has a sharper change in voltage for a certain change in temperature compared to current standard. Although there may be other materials that can result in a greater accuracy in temperature, Gallium Antimonide is easier to create and more cost effective. The thermopile will also have a bias voltage in the circuit that can be used to change the field of view (FOV) of the sensor. By changing the FOV, the sensor can limit its view to the food only so that the area each pixel is representing on the food is smaller, thus resulting in a greater accuracy.

As the temperature sensor array collects data a microcontroller analyzes data real time and able to determine viscosity of the food through graph interpolations. With knowledge of the thermodynamic properties of the microwave oven and analyzing the thermal profile from the temperature data from the sensor, properties of the food such as viscosity and amount can be determined. Using these properties, a general target temperature and cooking time is determined so that the user receives the food at perfect "lip-ready" temperature. User preference for certain food grade is also customizable and intelligently applied.

Figure 7:
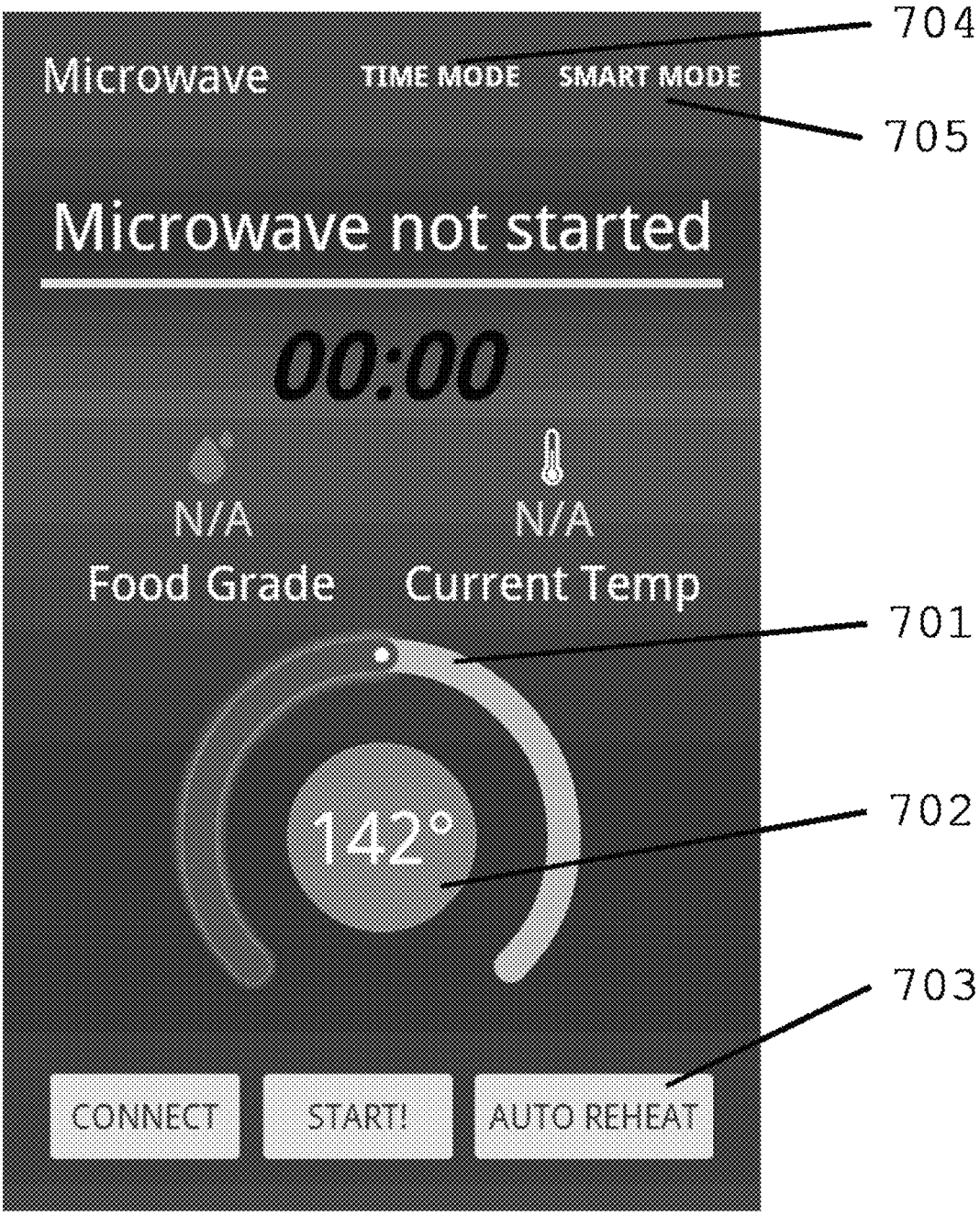
FIG. 7. is a photograph of the initial interface screen shown on the user peripheral device that displays output from the food detection software and enables the user the configure the food target temperature.
Figure 8:
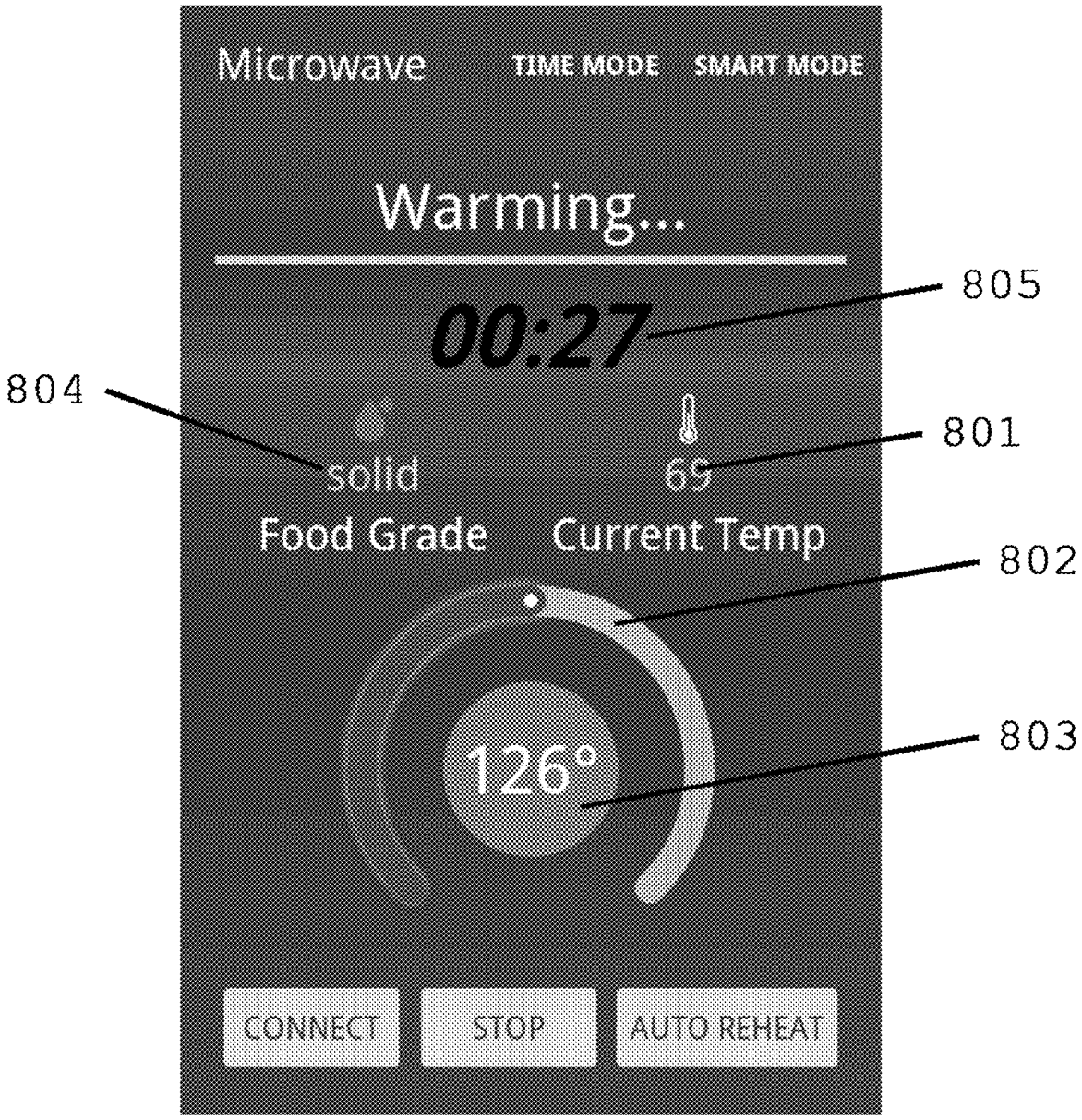
FIG. 8. is a photograph of the main interface screen shown on the user peripheral device as a food is warming.
Figure 9:
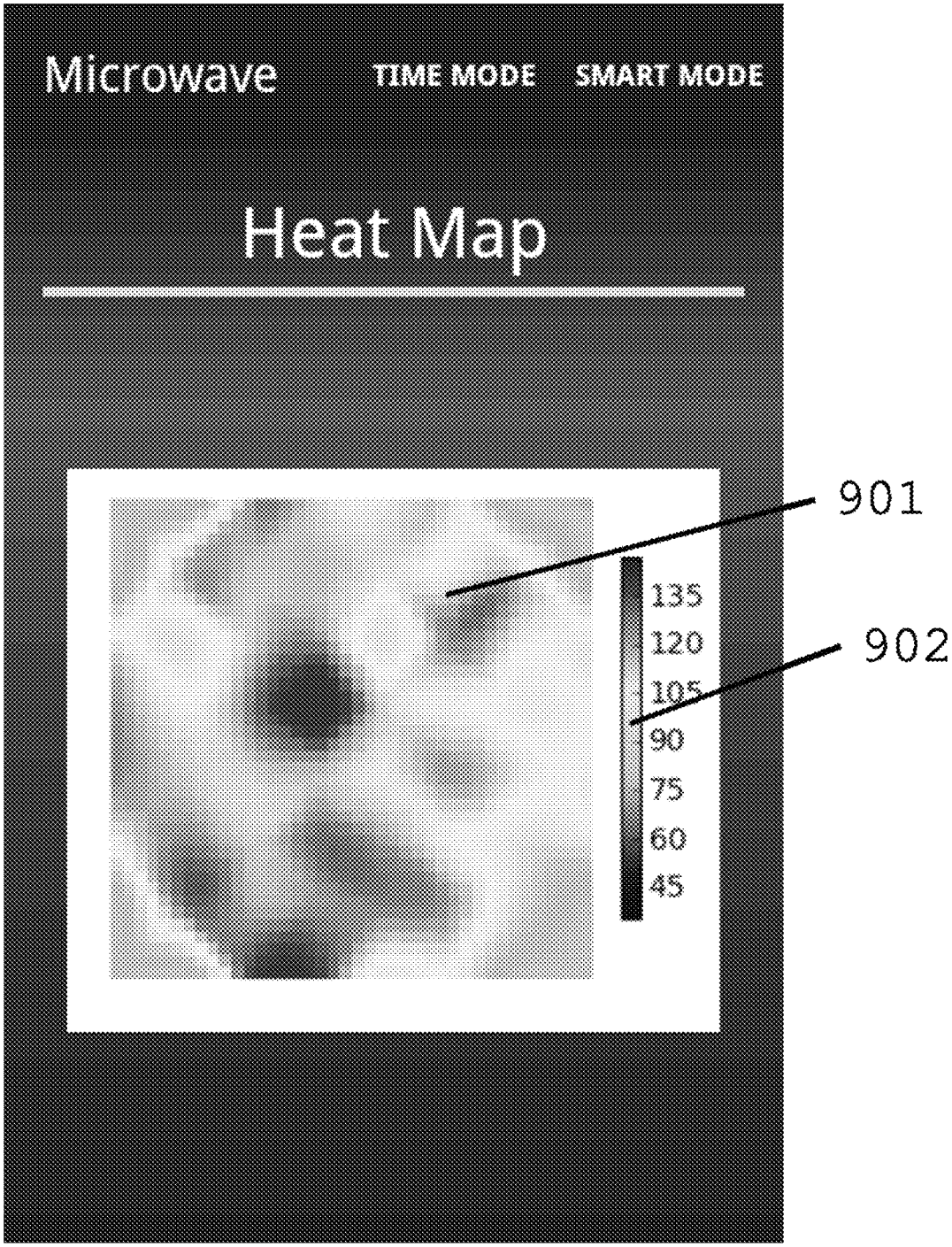
FIG. 9. is a photograph of an interface screen shown on the user peripheral devices displaying a real-time heat map of the food located inside the microwave oven enclosure.

If a user of the invention prefers a temperature or cooking time that is slightly different from the general population average, the user can change the values calculated through the touch screen interface on a peripheral device such as a smartphone or a screen mounted on the front of the oven. The cooking device can be configured as an internet connected IOT-device, through Bluetooth, Wi-Fi or other wireless communication interfaces. The user will then connect to the cooking apparatus and remotely change the target temperature or cooking time. A highly streamlined and simple, yet elegant smartphone application has been developed. Screenshots of the application is provided FIGS. 7, 8 and 9. In FIG. 7, the dial 701 on the bottom of the screen is set to 142 degrees Fahrenheit and is displayed at 702. If the user prefers to use a conventional interface to simply set the cooking time, the user can simply switch between time mode and smart mode as labeled in 704 and 705. If the user is prefers to retrieve the food at a later time, the auto reheat button 703 can be used to maintain food temperature. FIG. 8 shows the smartphone screen while the food is warming. The food type detected by the software is presented in 804 and the current temperature of the food is shown in 801. In addition, the remaining cooking time is shown in 805. In the figure, the target temperature 803 was changed in the application to 126 in degrees Fahrenheit on the dial 802 as user-specific preference override. In FIG. 9, a temperature heat map of the food is shown so the user can see temperature change of the food in real-time with the heat map 902 temperature bar 901. Remote application of such controls away from microwave oven also opens possibilities such as early defrosting start or smart rewarming.

Furthermore, depending on the actual application of home vs. industrial needs, and the computation capability of the microcontroller in the oven, if the computation is too intensive, the oven can be made into an IOT device. Solutions for cloud based efficient computation has also been devised as a part of this novel innovation. In this case, the cloud offers further orchestration of features using a extreme fast-processing computer in an online server away from the cooking apparatus. The computation is then used by this novel technology to determine the general desired ending temperature or time state of the food referred to as "target temperature (or time)" elsewhere in this document. This target temperature value is very much dependent on a given type of food. For example, foods that are more liquid, such as soup or tea, are desired at a warmer temperature while rice or chicken are wanted relatively cooler. This novel technology is capable of determining the food properties including viscosity and amount on a relative scale also computationally.

Figure 2:
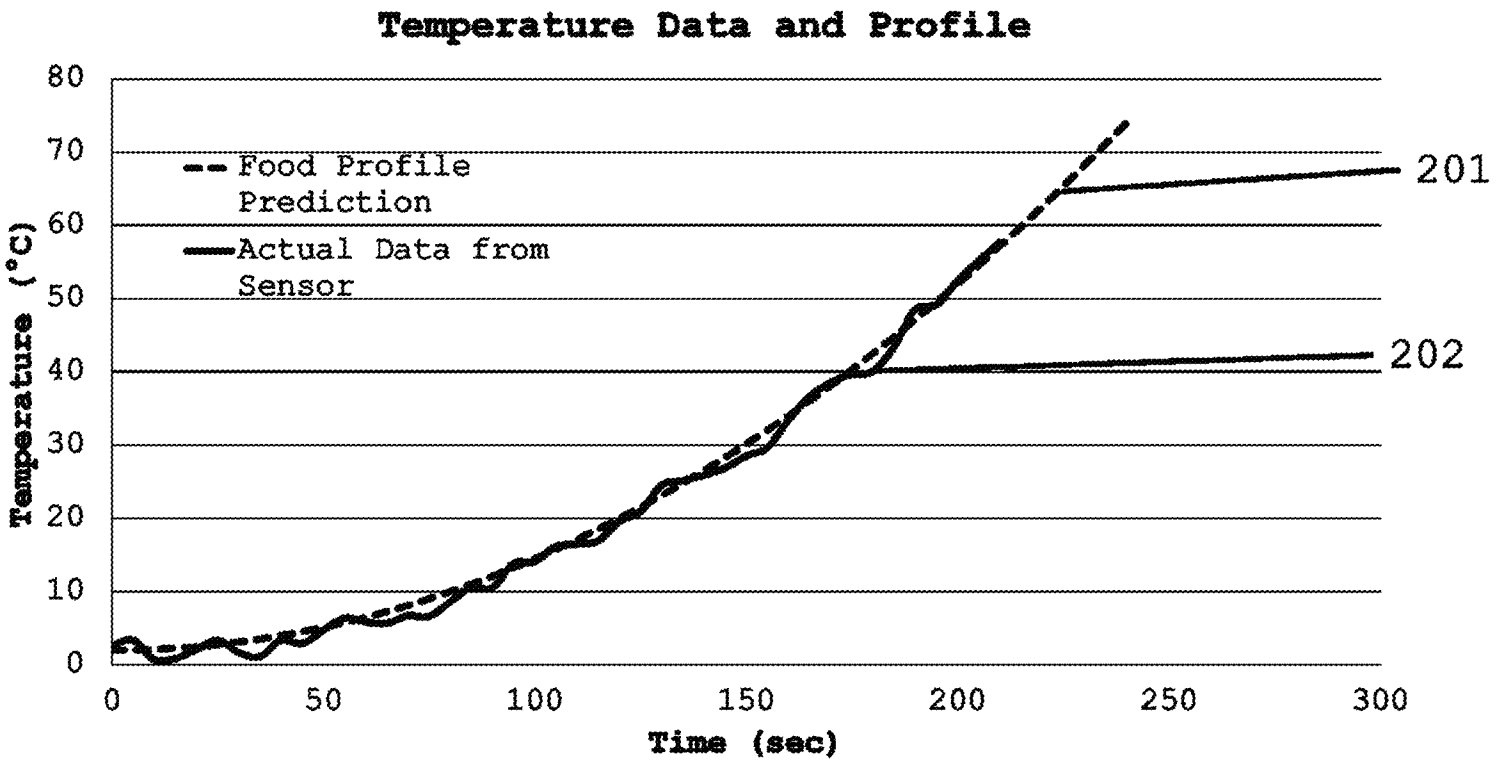
FIG. 2. is a graph comparing the temperature over time data received from a single pixel in the temperature sensor array and the virtual food profile prediction calculated by the computational software.
Figure 3:
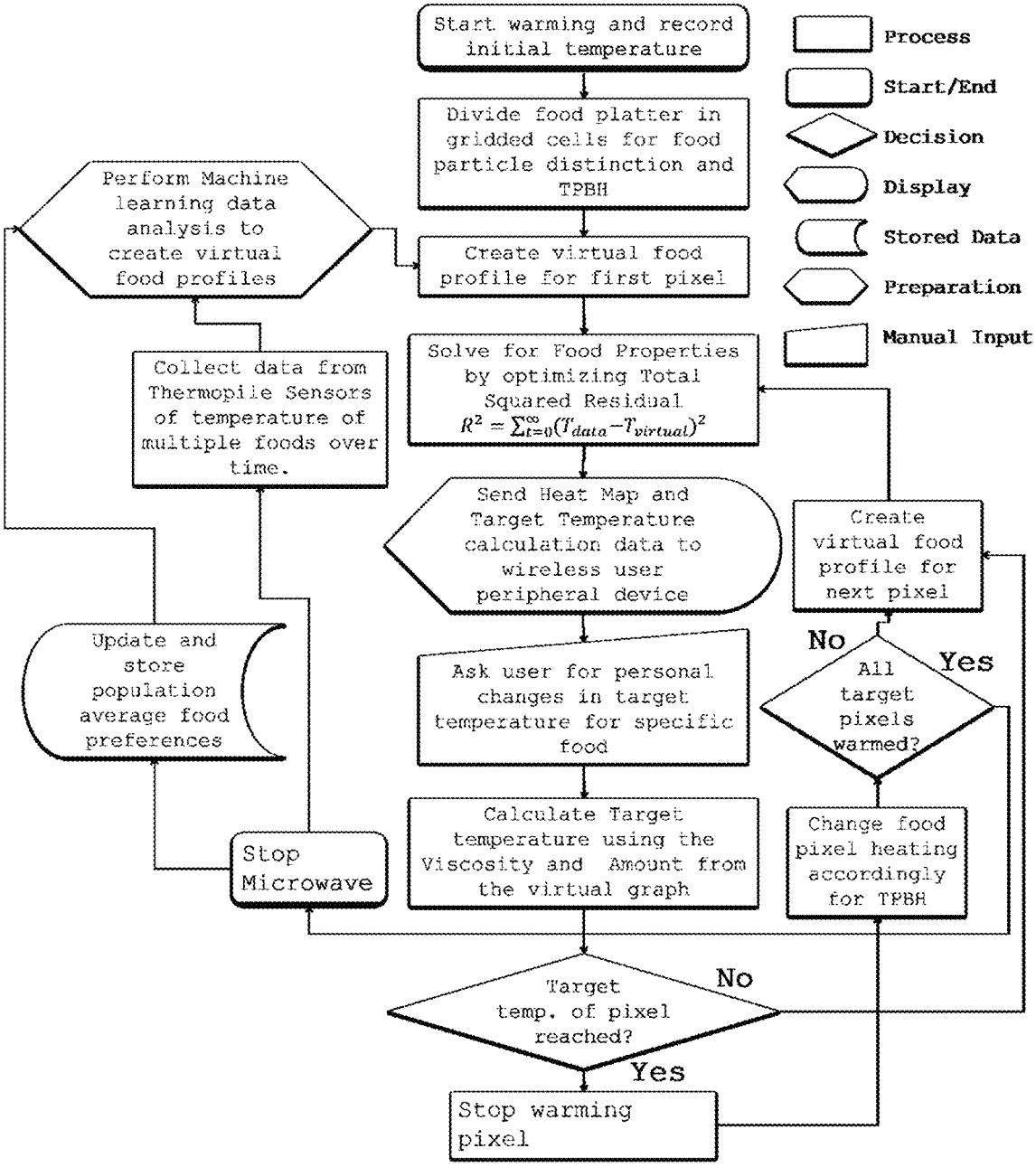
FIG. 3. is a flow chart describing the computational method and process used in the software.

This elegant solution is accomplished by creating a virtual food environment inside the computation device. The data from the temperature sensor array will be compiled into a temperature over time graph, or profile, for each pixel. The software divides the food in accordance to these pixels and creates three dimensional model of food inside the oven. A virtual food profile for each "food pixel" is created. FIG. 2 shows an example of a virtual food profile 201, and actual data received from the sensor 202. By creating changing food properties (viscosity, amount, liquid content, thermodynamic properties, mass, etc.) of the virtual profiles 201, the virtual profile can be made to match the actual food profile collected from the data 202. The food properties that are calculated in the virtual profiles can be then used in other processes described subsequently. With modern microcontrollers capable of fast computing and multivariate mathematical parameter optimization, the food properties (learned features of the food) of the food can be solved for. These mathematical calculations include Bayesian Analysis, machine-learning, interpolation and multivariate optimization methods. This method makes heavy use of software and a code architecture diagram is presented in FIG. 11. A flow chart of a computational method is shown in FIG. 3. These virtual profiles are obtained from machine-learned models from actual, real sensor data. The compute device performing these calculations can be located inside the oven (microcontroller/microprocessor), or remotely, as a wireless user peripheral device (such as a smartphone) or a cloud server. The process of collecting data from the temperature sensor array, processing the data through the software and sending the results to the user are all shown in the flow diagram in FIG. 3.

Figure 10:
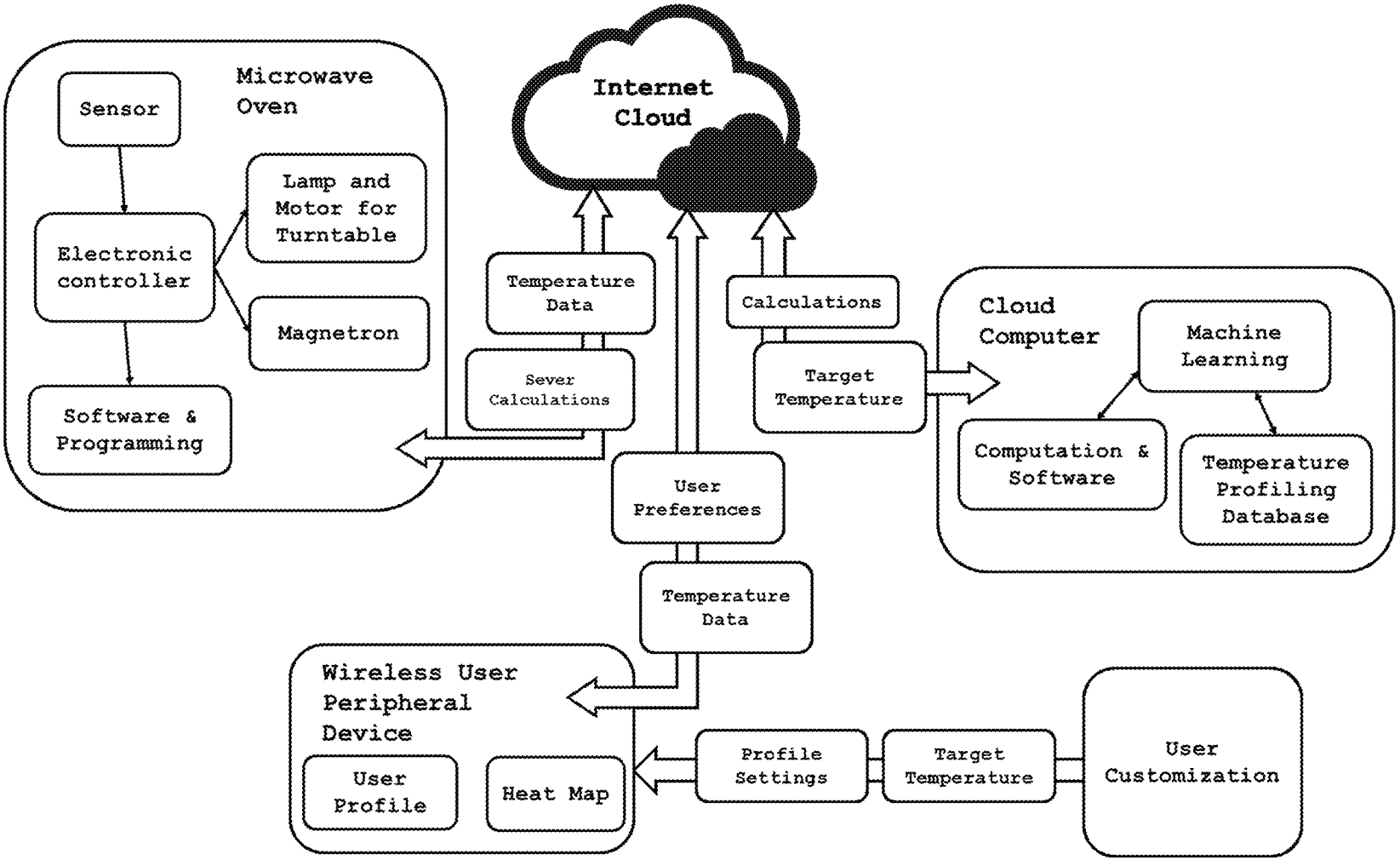
FIG. 10. is a diagram of the data transfer scheme showing information transferred between devices through the internet cloud.

In addition, a diagram of all electronic devices in the scheme of this invention are located in FIG. 10, where devices are shown and is sent between each of the devices through the internet. In the case of the compute device being located remotely, the microcontroller in the oven connects to the remove compute device via wireless communication (internet, WiFi, Bluetooth, etc.). Then, the temperature data, and/or food platter positional information is sent by the microcontroller to the compute device and the intelligently calculated instructions are sent from the compute device to the microcontroller as a response. The arrows in FIG. 10 illustrates this data transfer as labeled arrows connected between each device.

Figure 11:
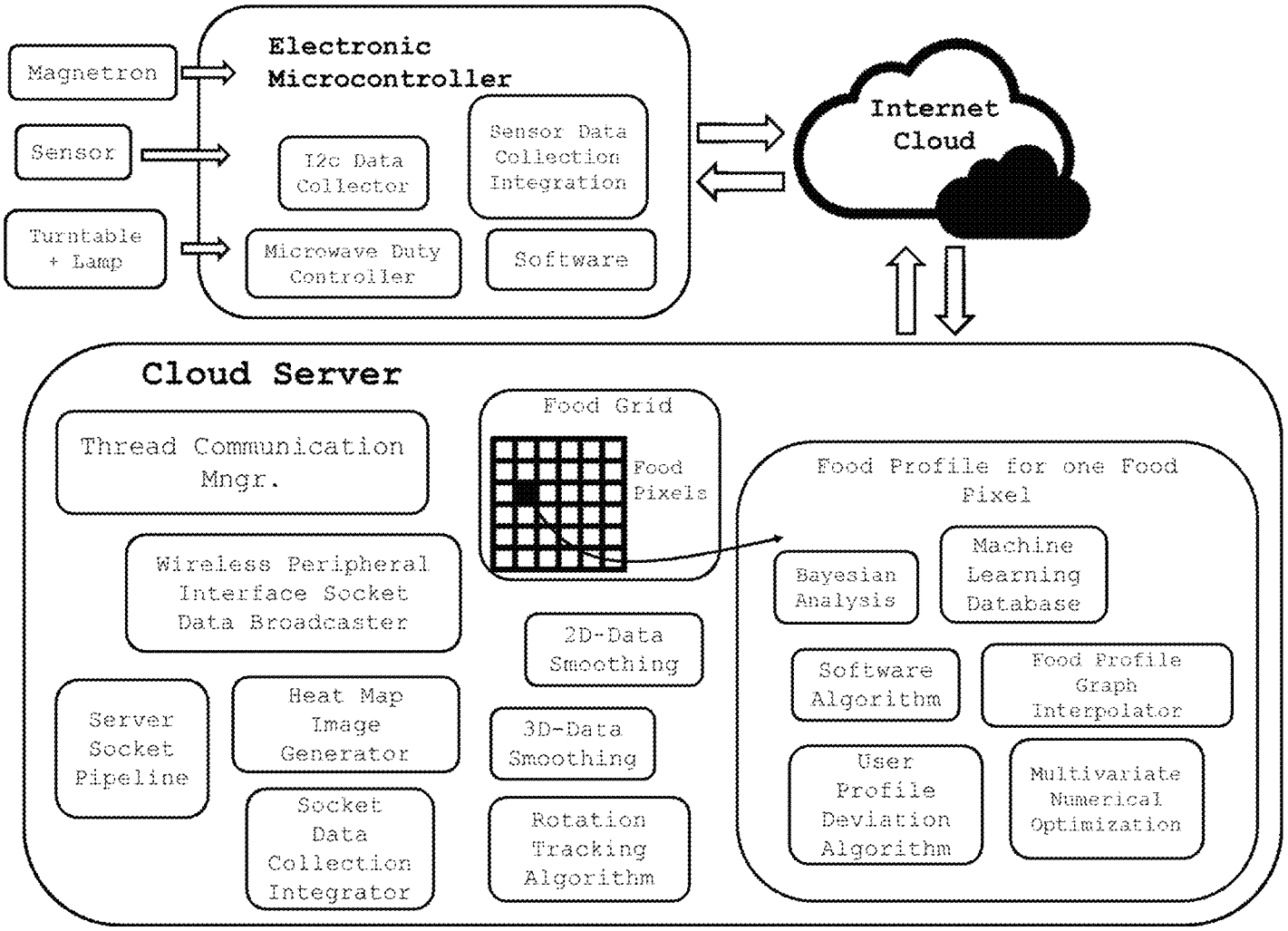
FIG. 11. is a diagram of the intelligent code architecture in each device in the invention scheme used by the computational software.

As described before, if the user is able modify their target temperature or time preferences for intelligent personalization, if their preferences deviate from the population average. This is done by computing a model relating food properties of the given food to the user-specific temperature preferences. A database of machine-learned target temperature/time characteristics is stored, and a user profile deviation algorithm is used to compute this model. These calculations involve complex interpolation, machine-learning techniques integrated into a proprietary software. Both of these elements and where they integrate into the larger architecture scheme are shown in FIG. 11. The integration of the user-specific preference model, the virtual food profile modeling, food property computation and the target temperature or time determination is shown in the flow chart in FIG. 3. The user has the ability to update their preferences even while warming the currently placed food which will be used to update the target temperature or time calculation in the virtual food profile modeling software.

Figure 4:
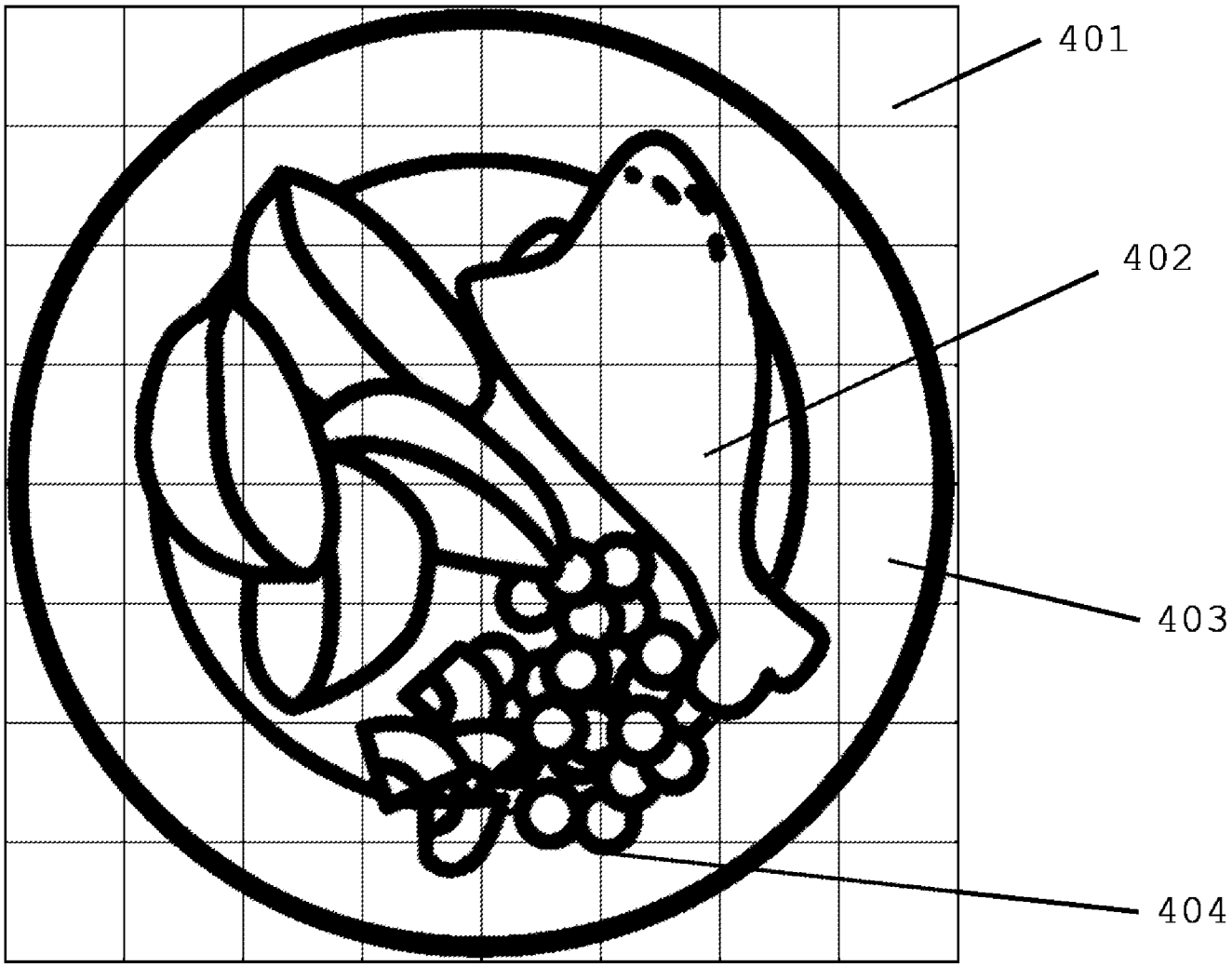
FIG. 4. is a diagram displaying an example food platter and a superimposed grid to demonstrate the selective heating utilized by the TBPH computational software.

In order to differentiate different types of food on the same food platter, the invention's novel software labels each cell in the pixel-grid in the measurement as individual food particles. In the method, each cell in the heat map registers its own, separate food property values. This allows for "Targeted Pixel Based Heating" (TBPH). The microwave oven is modified to direct heat to specific locations in the food platter thus targeting only the pixels which need heating (An explanation of this is given in the next paragraph). An example food plate is shown in FIG. 4, which shows food that is divided into cells/pixels based on grid 401. The electronic controller controlling the microwave generator, motor, and other parameters would then use TPBH to heat only necessary areas in the food platter. In the grid, the cells detect food particles at 402 and 404 and the plate 403 not identified as a food particle. The oven heats the chicken 402 while avoiding warming of food such as salad 404. Through usage of TPBH the heating of metal utensils, ceramic bowls and other wares will not be warmed and thus burns caused by heating these items can be prevented.

Figure 6:
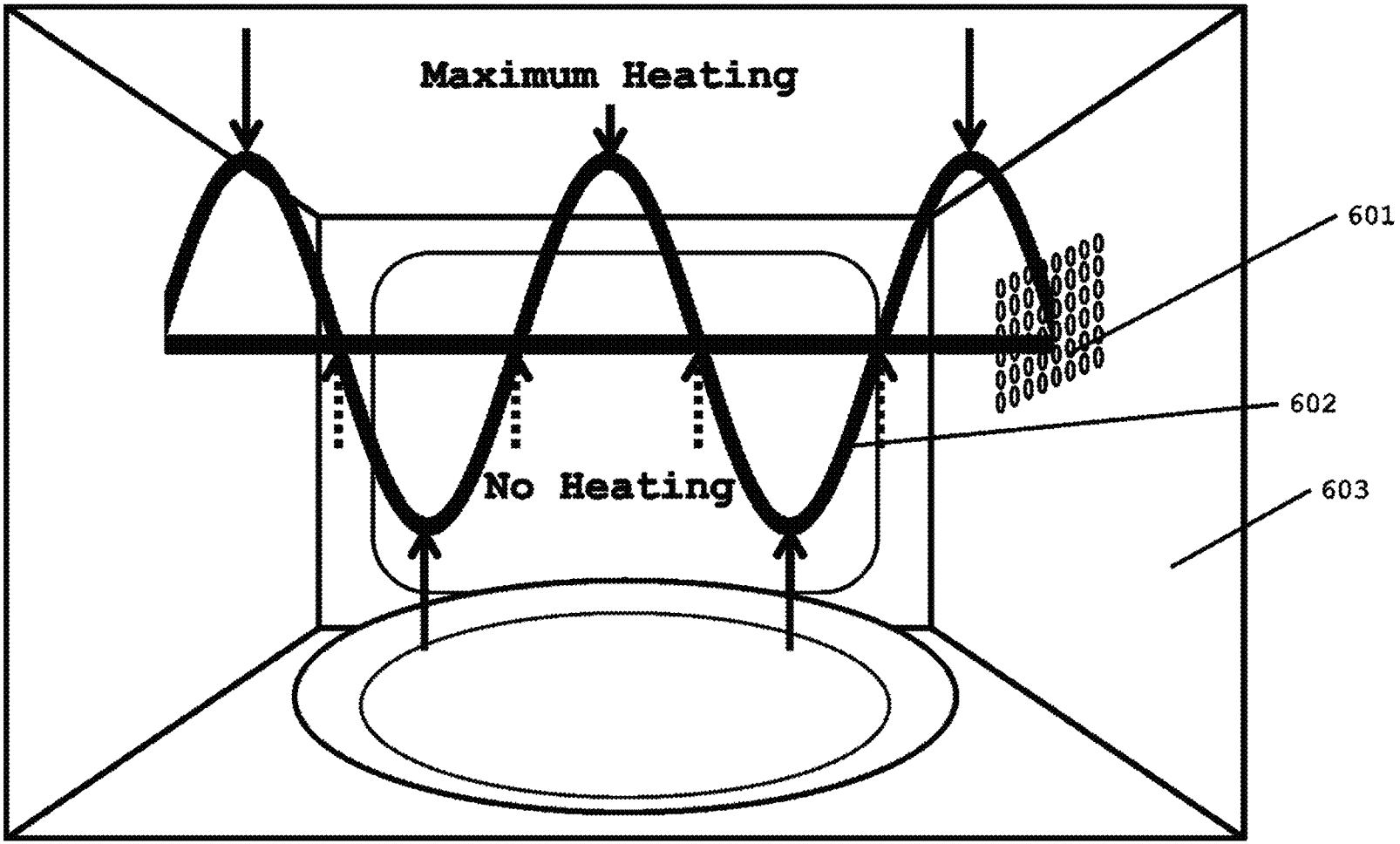
FIG. 6. is a diagram of the inside of microwave oven enclosure showing the electromagnetic standing wave's nodes and anti-nodes generated by the microwave generator which produces uneven heating.

The invention as shown in FIG. 6 involves a microwave generator located in the oven. In particular, the microwave 602 comes out of the side of the cooking appliance 601 which causes vibration of the polar molecules of water inside the food which in turn generates heat. The amount of heat varies depending on the location in the standing wave 602. Heating is at maximum on the high and low points of the wave (anti-nodes) and is at minimum at the middle nodes where there is no electromagnetic polarity (nodes). This causes differentiated heating zones inside the oven cabin where food is located. The location of the nodes and anti-nodes of the microwave standing wave can be further mechanically controlled through polarization or electrically controlled through phase shifting of the waves created by the microwave generator. In some cases, the microwave radiation can pose problem for IR temperature sensor data collection. To compensate for the power on/off state of the microwave generator (magnetron) can be controlled in a duty cycle control scheme (shown in FIG. 11). While the microwave generator is off, the electronic controller can take clean measurements of the temperature data.

Figure 5:
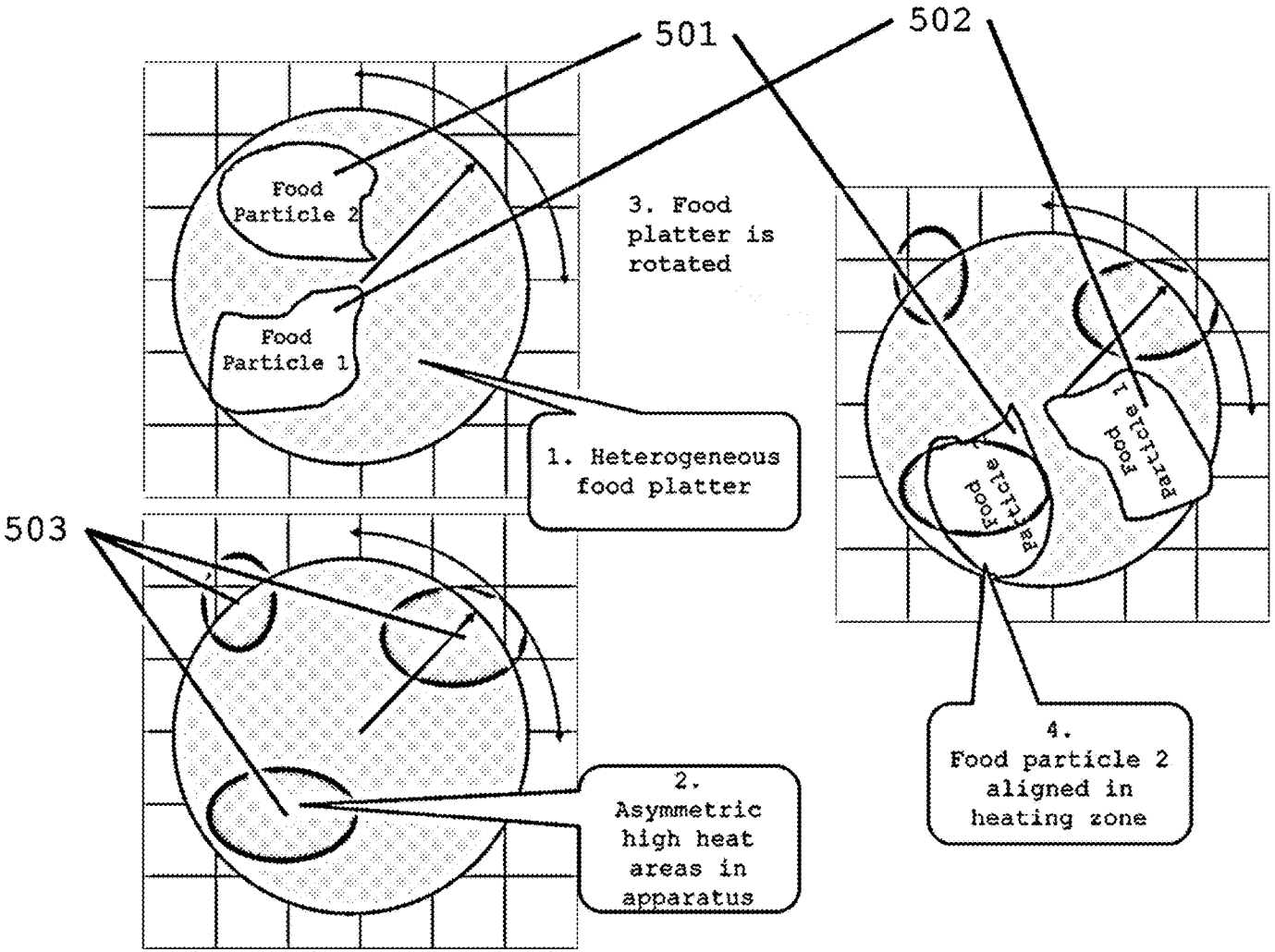
FIG. 5. is a diagram of the physical side of an implementation of TPBH in which rotation is used to selectively heat food particles.

In conventional ovens, the platter rotates continuously to apply heating evenly. However, this poses difficulties to TPBH as now the food itself is moving. In order to compensate for this, the temperature data and location of each food particle on the platter 603 is meticulously tracked, based on the revolution speed of the platter so that the data matches the pixel locations when warming began, enabling temperature-motion tracking. A stepper motor is then used to rotate the food platter to the appropriate location so that the heating zones of the microwave are optimally aligned with the foods that need to be heated, as determined from the food properties modeling software. The rotation, direction, speed and rotational position of the stepper motor is controlled by the electronic controller in order to rotate the food platter in this fashion. A diagram of the implementation of TPBH is shown in FIG. 5. Once food particles 501 and 502 have been identified, the platter is rotated to ensure targeted food particles align in heating zones 503 created by the standing (micro)waves in the oven cabin. This will account for any microwave ovens with uneven heating as now rotation of the food platter can be used more efficiently to achieve desired results.

In total, a novel scheme is presented for the intelligent and automatic cooking of given food in a microwave oven. The software present divides the computation tasks among the microwave oven's controller as well as remote compute devices or user input devices to enable multiple configurations of this architecture, enabling costly high-end as well as cheap low-end systems for multipurpose use in home or industry. The ensemble of intelligent machine-learning, interpolation and optimization software is precisely designed for the microwave oven apparatus and its configurations. The virtual food profile method is able to take in temperature over time data as input and compute food properties and optimal target temperature or time values. User-specific temperature or time preferences are stored in a learned database to generate a model to that allows the personalized target temperature or time to be outputted given the properties of placed food. A stepper motor has been introduced as well as food location and pixel data tracking methods to enable the oven to selectively heat food on different locations on the food platter, thus creating a fully intelligent cooking experience for the user.

The invention claimed is:

1. A cooking system comprising:

an oven housing defining an inside heating cabin, wherein the inside heating cabin is configured to receive a platter containing food;

a microwave generator contained inside the oven housing and configured for generating microwaves in order to heat the food in the inside heating cabin;

an IR temperature sensor array mounted within the oven housing and configured to generate temperature data for a plurality of portions of the food for a plurality of times; and a processor system connected to the microwave generator and the IR temperature sensor array, wherein the processor system is configured to selectively heat different portions of the plurality of portions of the food by performing the steps of:

cause the microwave generator to initiate heating the food with microwaves, receive the temperature data for the plurality of portions of the food comprising time and temperature pairs for each of the plurality of portions of food, wherein at least a portion of the time and temperature pairs for each of the plurality of portions of the food are obtained after heating of the food is initiated, generate a first food profile from the received temperature data based on time and temperature pairs for a first portion of food of the plurality of portions of food, generate a second food profile from the received temperature data based on time and temperature pairs for a second portion of food of the plurality of portions of food, correlate the first food profile with a first virtual food profile of a plurality of virtual food profiles, wherein the first virtual food profile corresponds to a first target heating temperature, correlate the second food profile with a second virtual food profile of the plurality of virtual food profiles, wherein the second virtual food profile corresponds to a second target heating temperature, different than the first target heating temperature, and control the microwave generator and/or a turntable in the inside heating cabin in order to deliver different amounts or intensities of microwaves to the first portion of food and the second portion of food so that the first portion of food is heated to the first target heating temperature and the second portion of food is heated to the second target heating temperature, wherein the processor system is configured to control speed, rotation direction, and rotational location of the turntable in order to deliver the different amounts of microwaves, and wherein the different amounts of microwaves are delivered by rotating the turntable to selectively position food portions of the plurality of food portions in higher heating zones inside the heating cabin in order to deliver the different amounts of microwaves.

2. The cooking system of claim 1, wherein the processing system comprises a cloud server, wherein the temperature data for the plurality of portions of the food for the plurality of times is sent to the cloud server, and wherein the cloud server is configured to perform the steps of comparing the first food profile with the plurality of virtual food profiles and comparing the second food profile with the plurality of virtual food profiles.

3. The cooking system of claim 1, wherein the processor system is configured to control intensity of the microwaves generated by the microwave generator in order to deliver the different amounts of microwaves.

4. The cooking system of claim 1, wherein the processor system is configured to control polarization of a standing wave generated by the microwave generator in order to deliver the different amounts of microwaves.

5. The cooking system of claim 1, wherein the processor system is configured to vary a bias voltage to the IR temperature sensor in order to control a field of view of the IR temperature sensor for optimal coverage and/or resolution of the food in the oven.

6. The cooking system of claim 1, wherein the plurality of virtual food profiles comprise time and temperature pairs defining time and temperature plots used in steps for correlating the first and second food profiles with the plurality of virtual food profiles.

7. The cooking system of claim 1, wherein correlating the first food profile with the first virtual food profile comprises performing a total squared residual optimization of the first food profiles with the plurality of virtual food profiles.

8. A cooking system comprising:

an oven housing defining an inside heating cabin, wherein the inside heating cabin is configured to receive a platter containing food;

a microwave generator contained inside the oven housing and configured for generating microwaves in order to heat the food in the inside heating cabin;

an IR temperature sensor array mounted within the oven housing and configured to generate temperature data for a plurality of portions of the food for a plurality of times; and a processor system connected to the microwave generator and the IR temperature sensor array, wherein the processor system is configured to selectively heat different portions of the plurality of portions of the food by performing the steps of:

cause the microwave generator to initiate heating the food with microwaves, receive the temperature data for the plurality of portions of the food comprising time and temperature pairs for each of the plurality of portions of food, wherein at least a portion of the time and temperature pairs for each of the plurality of portions of the food are obtained after heating of the food is initiated, generate a first food profile from the received temperature data based on time and temperature pairs for a first portion of food of the plurality of portions of food, generate a second food profile from the received temperature data based on time and temperature pairs for a second portion of food of the plurality of portions of food, correlate the first food profile with a first virtual food profile of a plurality of virtual food profiles, wherein the first virtual food profile corresponds to a first target heating temperature, correlate the second food profile with a second virtual food profile of the plurality of virtual food profiles, wherein the second virtual food profile corresponds to a second target heating temperature, different than the first target heating temperature, and control the microwave generator and/or a turntable in the inside heating cabin in order to deliver different amounts or intensities of microwaves to the first portion of food and the second portion of food so that the first portion of food is heated to the first target heating temperature and the second portion of food is heated to the second target heating temperature, wherein correlating the first food profile with the first virtual food profile comprises performing a total squared residual optimization of the first food profiles with the plurality of virtual food profiles.

9. The cooking system of claim 8, wherein the processing system comprises a cloud server, wherein the temperature data for the plurality of portions of the food for the plurality of times is sent to the cloud server, and wherein the cloud server is configured to perform the steps of comparing the first food profile with the plurality of virtual food profiles and comparing the second food profile with the plurality of virtual food profiles.

10. The cooking system of claim 8, wherein the processor system is configured to control intensity of the microwaves generated by the microwave generator in order to deliver the different amounts of microwaves.

11. The cooking system of claim 8, wherein the processor system is configured to control polarization of a standing wave generated by the microwave generator in order to deliver the different amounts of microwaves.

12. The cooking system of claim 8, wherein the processor system is configured to vary a bias voltage to the IR temperature sensor in order to control a field of view of the IR temperature sensor for optimal coverage and/or resolution of the food in the oven.

13. The cooking system of claim 8, wherein the plurality of virtual food profiles comprise time and temperature pairs defining time and temperature plots used in steps for correlating the first and second food profiles with the plurality of virtual food profiles.

* * * * *